US005862601A

United States Patent [19]

O'Brien et al.

[11] Patent Number: 5,862,601

[45] Date of Patent: Jan. 26, 1999

[54] TRACING TOOL

[76] Inventors: James L. O'Brien, 123 Forest Hill Ave., Lynnfield, Mass. 01940; Michael Mulkerrins, 16 Home St., Malden, Mass. 02148

[21] Appl. No.: 728,206

[22] Filed: Oct. 10, 1996

Related U.S. Application Data

[63] Continuation-in-part of Ser. No. 436,609, May 8, 1995, abandoned.

[51] Int. Cl.[6] ..... B43L 13/02

[52] U.S. Cl. ..... 33/42; 33/41.5; 33/41.6

[58] Field of Search ..... 33/42, 41.1, 41.5, 33/41.6, 43, 44

[56] References Cited

U.S. PATENT DOCUMENTS

| | | | |
|---|---|---|---|
| 2,581,534 | 1/1952 | Hungerford | 33/41.5 |
| 2,603,873 | 7/1952 | Shaw | 33/42 |
| 2,660,791 | 12/1953 | Howell et al. | 33/41.6 |
| 4,656,744 | 4/1987 | Decker | 33/42 |
| 4,858,327 | 8/1989 | Johns | 33/42 |

*Primary Examiner*—Christopher M. Fulton
*Attorney, Agent, or Firm*—William Nitkin

[57] ABSTRACT

A tracing tool for marking an outline of an irregular surface onto a sheet of material so that the sheet of material can be cut along such outline to fit snugly against the irregular surface, such tool including a case having a cavity in communication with an opening in the case, such case enclosing a piston having a shaft linearly extending therefrom through the case opening with a spring biasing the piston toward the case opening, and a marking device passing through a marking hole in the shaft which marking hole is perpendicular to the plane of the sheet of material. The shaft at its end includes a horizontally disposed guide roller for facilitating sideways rolling of the shaft along the irregular surface while the shaft moves back and forth perpendicularly to the irregular surface which movement moves the piston in the cavity as the marking device marks the outline of the irregular surface on the sheet of material.

4 Claims, 2 Drawing Sheets

TRACING TOOL

This application is a continuation-in-part of our previous application under the same title, Ser. No. 08/436,609 filed May 8, 1995, now abandoned.

BACKGROUND OF THE INVENTION

1. Field of the Invention

This invention resides in the area of tracing or scribing tools, and more particularly relates to a tracing tool for marking the outline of an irregular surface onto a sheet of material, such sheet to be cut along the outline to be able to fit snugly against the irregular surface.

2. Description of the Prior Art

The following U.S. patents are illustrative of the prior art:

U.S. Pat. No. 219,942 to Heiran issued Sep. 23, 1879

U.S. Pat. No. 1,577,569 to Donley issued Mar. 23, 1926

U.S. Pat. No. 1,792,323 to Phillips issued Feb. 10, 1931

U.S. Pat. No. 3,875,664 to Diner issued Apr. 8, 1975

SUMMARY OF THE INVENTION

It is an object of the instant invention to provide a new and improved tracing tool for marking the outline of an irregular surface, such as an irregular wall, ceiling or other surface, onto a sheet of material, such as plywood or plasterboard, so that such sheet of material can be cut along such irregular outline to fit snugly against the mating irregular surface.

A further object of the instant invention is to provide a tracing tool which can be economically manufactured.

A yet further object of the instant invention is to provide a tracing tool which is easy to use and which requires only one hand to operate.

A still further object of the instant invention is to provide a tracing tool which in use does not require the aid of other tools and does not have to be kept at a specific measured distance from the irregular surface being traced.

A yet still further object of the instant invention is to provide a tracing tool which can be used on a sheet of a number of different types of material including, but not limited to, plywood, paneling, wallpaper, plasterboard or tile.

To attain these objects, the tracing tool of this invention generally includes a case, an piston, a shaft linearly aligned with the piston, a spring and a marking device. The case has an opening at one end and a cavity within the case in communication with the opening. The piston snugly, yet slideably, fits within the cavity of the case. The case also contains a spring disposed within the cavity which biases the piston out of the cavity towards the opening. The shaft has a marking hole through it in which is placed a marking device having a marking tip. The marking device can be held securely therein by a setscrew and is positioned so that the marking tip extends below the bottom of the shaft which is adjacent to the surface of the sheet of material to be marked.

In use, the tracing tool is placed parallel to the plane of the sheet of material so that the marking tip of the marking device at the front of the tool is in contact with the sheet. At the same time the tracing tool is placed perpendicular to the irregular surface to be traced so that the front end of the shaft is in contact with the irregular surface. The tracing tool is then moved sideways from right to left or from left to right. As the tool moves sideways, the piston and shaft, biased by the spring, slide back and forth moving the piston in the cavity of the case as the shaft follows any irregularities of the surface being traced. The marking device moves with the shaft as the attached piston moves back and forth within the case, responding to surface irregularities. As the marking device moves, the marking tip leaves an outline of the surface to be traced on the sheet of material.

The instant invention therefore is easy to use, requires only one hand to operate and does not need to be placed at a specific measured distance from the surface of the wall or ceiling to be outlined. All that is required is that the front of the shaft stay in contact with the surface and the marking tip stay in contact with the sheet of material.

One means for preventing the piston from being biased completely out of the cavity is to attach tabs to the top and bottom of the piston adjacent to the end of the piston. A cap is then attached to the case over the opening which cap has an aperture large enough to allow the shaft to slide therethrough yet small enough to prevent the tabs on the piston from sliding therethrough. The cap therefore prevents the spring from biasing the piston completely out of the cavity. Other equivalent means to retain the piston within the cavity can also be utilized.

It is also desirable in some embodiment to prevent the piston from rotating within the cavity to ensure that the marking tip of the marking device attached to the shaft stays in contact with the sheet of material. To that end, a groove can be provided in the top wall and bottom wall of the cavity which run from the opening along the entire length of the cavity. Mating tabs can be provided on the piston which fit within these grooves, thereby allowing the piston to slide back and forth within the cavity yet prevent the piston from rotating within the cavity. Other means to prevent rotation can also be used.

Yet another object of the instant invention is to provide a reduced friction contact between the end of the shaft and the irregular surface of the wall or ceiling. To that end, a guide roller can extend out of a horizontal slot at the front end of the shaft so that the axis of the guide roller is perpendicular to the shaft and piston and runs through the top and bottom of the shaft. The guide roller easily rolls along the irregular surface, such as of a wall or ceiling, as the tracing tool is moved sideways thereacross with the front end of the shaft in contact with the surface.

Yet still another object of the instant invention is to provide reduced friction support between the bottom of the case and the sheet of material. To that end, support rollers can be attached to the bottom of the case. The support rollers share a common axis which is parallel to the case and runs from the first end to the second end of the case. The support rollers easily roll along the sheet of material as the tracing tool is moved sideways.

Still yet another object of the instant invention is to provide means for holding the tracing tool while in use and for hanging the tracing tool when not in use. To that end a handle is attached to the top of the case. The handle allows the user to hold the tracing tool while it is in use and to hang or attach the tool to the user's clothing or tool belt when it is not in use.

DESCRIPTION OF THE PREFERRED EMBODIMENT(S)

Figure 1:
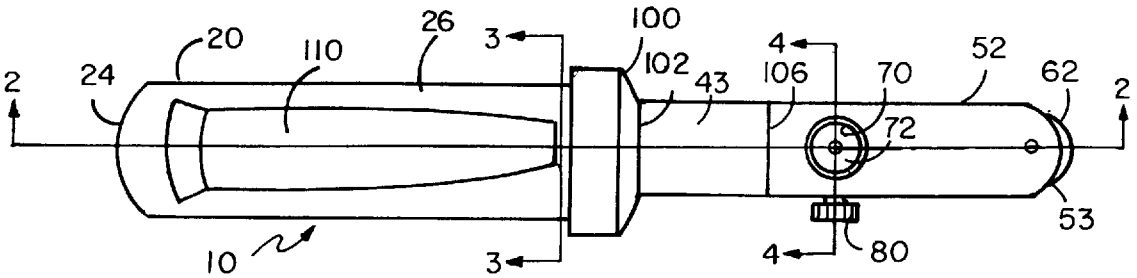
FIG. 1 illustrates a top view of the tracing tool of this invention.

Illustrated in FIGS. 1–4 is tracing tool 10 of this invention for marking an outline of an irregular surface, such as a wall or ceiling, onto a sheet of material, such as plywood or plasterboard, so that the sheet of material can be later cut along the outline to fit snugly against the irregular surface. Tracing tool 10 generally includes case 20, piston 40, shaft 52, spring 50 and marking device 72. Handle 110 is attached to top 26 of case 20 at its first end and has a second free end. Handle 110 has bend 54 near its first end such that its free second end extends parallel to case 20. Handle 110 can be used by the user to hold tracing tool 10 when in use, and when not in use, handle 110 can be used to hang tracing tool 10 on the user's clothing or tool belt.

Figure 2:
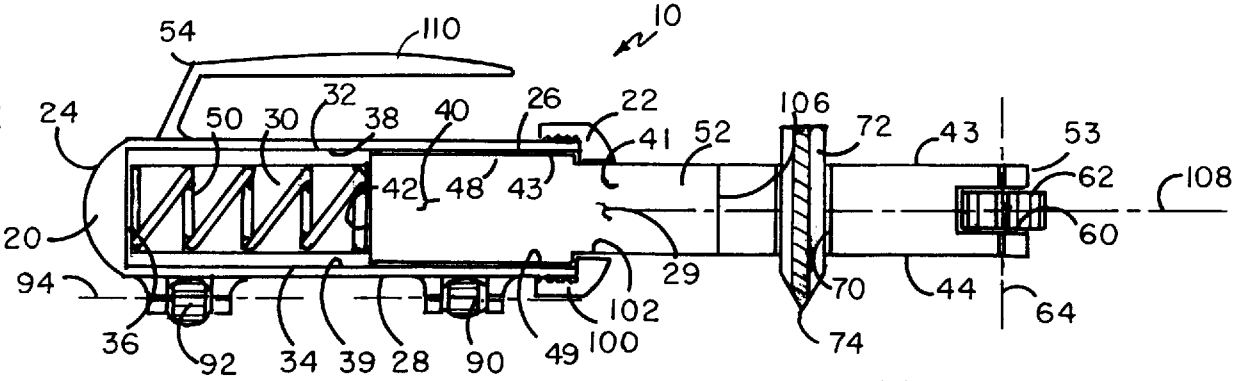
FIG. 2 illustrates a cross-sectional view of the tracing tool through line 2—2 of FIG. 1 in the direction indicated by the arrows.
Figure 4:
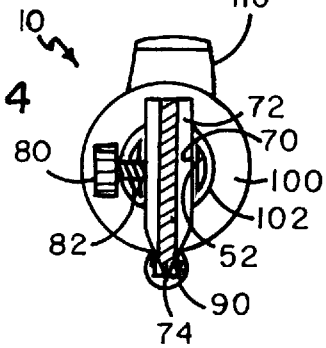
FIG. 4 illustrates a cross-sectional view of the tracing tool through line 4—4 of FIG. 1 in the direction indicated by the arrows.

As illustrated in FIG. 2, case 20 has a top 26, a bottom 28, a first end 22, a second end 24, an opening 29 at first end 22 and a cavity 30 which communicates with opening 29. Cavity 30 has a top wall 32, a bottom wall 34 and a back wall 36 opposite opening 29. Piston 40 has a top 43, a bottom 44, a first end 41 and a second end 42. Second end 42 of piston 40 snugly yet slideably fits within cavity 30 of case 20. First end 41 of piston 40 continues as shaft 52 to shaft end 53. Marking hole 70 extends from the top to the bottom of shaft 52. Marking hole 70 is located between shaft end 53 of shaft 52 and case 20 when piston 40 is inserted as far as possible within cavity 30. Shaft 52 also can have a threaded hole 82 disposed perpendicular to, and in communication with, marking hole 70 as seen in FIG. 4. Setscrew 80 screws into threaded hole 82. Marking device 72, having marking tip 74, can be adjustably positioned within marking hole 70 so that marking tip 74 extends below the bottom of shaft 52 sufficient to contact sheet 200. Marking device 72 is held securely within marking hole 70 by setscrew 80 when setscrew 80 is screwed through threaded hole 82 against marking device 72. Equivalent means of retaining the marking device within marking hole 70 can also be utilized. Case 20 also contains spring 50 located within cavity 30 between second end 42 of piston 40 and back wall 36 of cavity 30. Spring 50 biases piston 40 forward towards opening 29.

Figure 3:
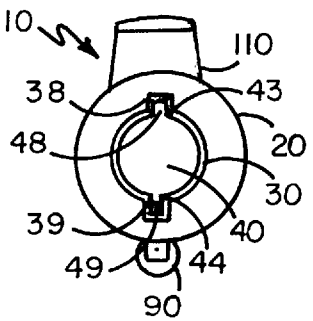
FIG. 3 illustrates a cross-sectional view of the tracing tool through line 3—3 of FIG. 1 in the direction indicated by the arrows.

Referring to FIGS. 2 and 3, it can be seen that first tab 48 is disposed on top 43 of piston 40 adjacent to second end 42 of piston 40, and second tab 49 is disposed on bottom 44 of piston 40 adjacent to second end 42 of piston 40. First groove 38 is located along top wall 32 of cavity 30, and second groove 39 is located along bottom wall 34 of cavity 30. First and second tabs 48 and 49 on piston 40 fit, respectively, within first and second grooves 38 and 39, allowing piston 40 to slide back and forth within cavity 30 yet preventing piston 40 from rotating within cavity 30. As seen in FIGS. 1, 2 and 4, cap 100 is attached to first end 22 of case 20 over opening 29. Cap 100 has an aperture 102 large enough to allow shaft 52 to slide therethrough yet small enough to prevent first and second tabs 48 and 49 from sliding therethrough. Thus cap 100 prevents spring 50 from biasing piston 40 completely out of cavity 30.

As seen in FIGS. 2 and 4, first support roller 90 is attached to bottom 28 of case 20, adjacent to first end 22; and second support roller 92 is attached to bottom 28 of case 20, adjacent to second end 24. First and second support rollers 90 and 92 share a common axis 94 which is parallel to case 20 and extends from first end 22 to second end 24.

Figure 5:
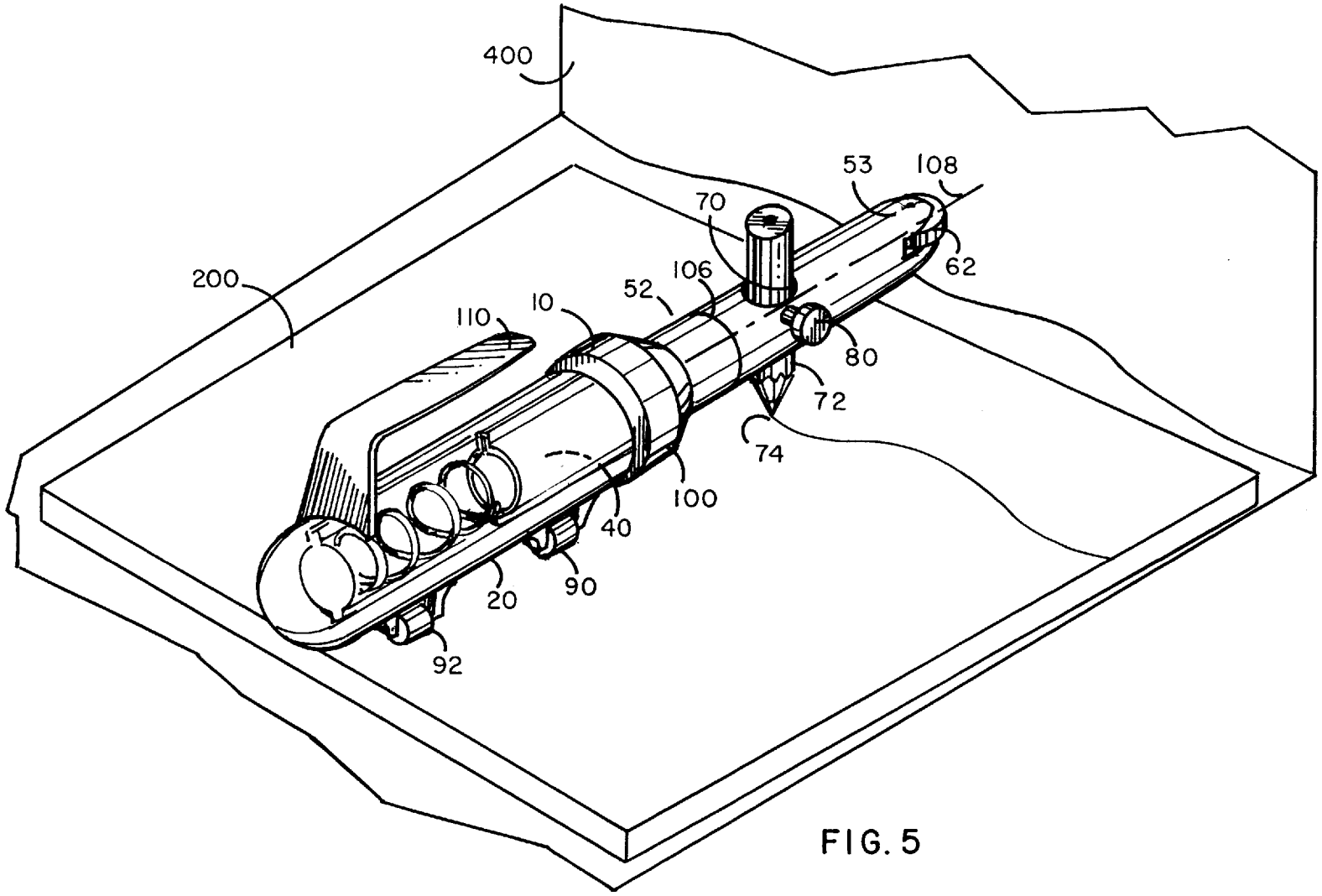
FIG. 5 illustrates a perspective view of the marking device of the tracing tool marking an outline of an irregular surface of a wall onto a sheet of material.

FIG. 5 illustrates a perspective view of tracing tool 10 in operation. Tracing tool 10 is placed parallel to the plane of sheet 200 of material and perpendicular to irregular surface 400 of the wall or ceiling to be traced. First and second support rollers 90 and 92 provide a reduced friction contact between case 20 and sheet 200 of material while guide roller 62 provides a reduced friction contact between shaft end 53 of shaft 52 and irregular surface 400 of the wall or ceiling. Marking device 72 is positioned within marking hole 70 and secured with setscrew 80 so that marking tip 74 is in contact with sheet 200 of material.

In use as tracing tool 10 is moved sideways, first and second support rollers 90 and 92 roll on sheet 200 of material while guide roller 62 rolls along surface 400 of the wall or ceiling. As tracing tool 10 moves sideways, piston 40 being moved by shaft 52 and biased by spring 50 which is not seen in this view, moves back and forth within case 20 as it follows any curves or irregularities in surface 400 of the wall or ceiling. Marking device 72 moves with shaft 52 as piston 40 moves back and forth, following surface 400. As marking device 72 moves, marking tip 74 leaves an outline 300 of surface 400 on sheet 200 of material.

The instant invention in operation requires only the use of one hand and does not need to be placed at a specific measured distance from surface 400 to outline the surface irregularities on the sheet of material. All that is required is that guide roller 62 stay in contact with surface 400 and that first and second support rollers 90 and 92 as well as marking tip 74 stay in contact with sheet 200 of material.

The tracing tool of this invention can be made of plastic, metal or equivalent material.

Other modifications of the present invention are possible in light of the above teachings. For example, more or fewer support rollers can be utilized if so desired. Ball bearings or Teflon-coated tips can be used in place of support rollers 90 and 92 or guide roller 62. Other means can be used in place of spring 50 for biasing piston 40 toward opening 29. Other ways can also be utilized for holding marking device 72 on or within piston 40. Marking device 72 can be a pencil, a grease pencil, a marker, a piece of chalk or other marking instrument. In addition, case 20, cavity 30 and piston 40 can have square or rectangular cross sections as opposed to the circular cross sections illustrated herein.

In yet another embodiment of the device of this invention, it can be desirable in situations where the side of case 20 can strike a member or an enclosure before guide roller 62 has completed its travel along surface 400 to have the end of shaft 52 be rotatable to allow marking device 72 by such rotation to continue its marking to the edge of sheet 200. This feature is accomplished by providing a swivel 106 along shaft 52 whereby the end portion of shaft 52 containing marking device 72 can be manually rotated about its axis 108 to the left or to the right as the need arises to extend the outline 300 to the edge of sheet 200. This rotation of marking device 72, when extended through marking hole 70 to maintain contact with sheet 200, will allow the extension of the line being drawn. Swivel 106 requires a firm manual rotation of shaft end 53 in order to effect shaft rotational movement. In normal use shaft end 53 will continue to hold marking device 72 in a position perpendicular to sheet 200.

Although the present invention has been described with reference to particular embodiments, it will be apparent to those skilled in the art that variations and modifications can be substituted therefor without departing from the principles and spirit of the invention.

We claim:

1. A hand-held tracing tool for marking an outline of an irregular surface onto a sheet of material so that said sheet of material can be cut along said outline to fit snugly against said irregular surface, said tracing tool comprising:

an elongate case having a first end and a second end, a cavity defined longitudinally within said case, an opening defined through said first end of said case and in aligned communication with said cavity, said cavity having a closed back wall at said second end of said case;

a piston having an outer end and an inner end, said piston being slidably disposed completely within said cavity with said outer end facing said opening and said inner end facing said cavity back wall;

an elongate shaft having a first end rigid with said outer end of said piston and extending therefrom through said case opening to a remote forward end, said case, piston and shaft having a common axis;

a marking device fixed to said shaft between said forward end of said shaft and said first end of said case, said marking device extending laterally from and below said shaft;

a spring located within said cavity between said inner end of said piston and said back wall of said cavity, said spring engaging said piston and biasing said piston toward said case opening and resiliently resisting inward movement of said piston and shaft;

an abutment on said case first end, said outer end of said piston selectively engaging against said abutment wherein forward movement of said piston through said opening is precluded;

a guide roller, means for mounting said guide roller on said forward end of said shaft and in linear alignment with said shaft for free rolling movement of said shaft along said irregular surface;

first and second freely rotatable support rollers mounted on and depending from said case respectively adjacent said first end of said case and said second end of said case for friction reducing movement of said tool over said sheet of material;

an elongate handle for manually holding and manipulating said tool with one hand when said tool is in use, and for hanging said tool when said tool is not in use, and means for mounting said handle on said case in closely spaced overlying parallel relation to said case between said first and second ends of said case.

2. The tracing tool of claim 1 including means for preventing said piston from rotating within said cavity of said case, and means for allowing a manual rotation of said marking device and a corresponding portion of said shaft about said axis of said shaft.

3. The tracing tool of claim 2 wherein said abutment comprises an annular cap removably mounted on said first end of said case and allowing free sliding axial movement of said shaft therethrough while precluding forward movement of said piston.

4. The tracing tool of claim 1 wherein said abutment comprises an annular cap removably mounted on said first end of said case and allowing free sliding axial movement of said shaft therethrough while precluding forward movement of said piston.

* * * * *